US012721399B2

(12) United States Patent
Tseng et al.

(10) Patent No.: US 12,721,399 B2
(45) Date of Patent: Sep. 1, 2026

(54) SHOE AND METHOD FOR DETERMINING FLATNESS OF GROUND

(71) Applicant: POU CHEN CORPORATION, Chang Hwa Hsien (TW)

(72) Inventors: Yu-Ping Tseng, Zhubei City (TW); Liang-Chia Tseng, Chang Hwa Hsien (TW)

(73) Assignee: POU CHEN CORPORATION, Chang Hwa Hsien (TW)

( * ) Notice: Subject to any disclaimer, the term of this patent is extended or adjusted under 35 U.S.C. 154(b) by 259 days.

(21) Appl. No.: 18/763,128

(22) Filed: Jul. 3, 2024

(65) Prior Publication Data

US 2025/0017312 A1 Jan. 16, 2025

(30) Foreign Application Priority Data

Jul. 10, 2023 (TW) ..... 112125700

(51) Int. Cl.
*A43B 3/44* (2022.01)
*A43B 3/40* (2022.01)

(52) U.S. Cl.
CPC . *A43B 3/44* (2022.01); *A43B 3/40* (2022.01)

(58) Field of Classification Search
CPC ..... A43B 3/44; G01B 17/08; G01B 21/30
See application file for complete search history.

(56) References Cited

U.S. PATENT DOCUMENTS

2002/0166264 A1* 11/2002 Shepherd ..... A43D 999/00 36/132
2009/0235739 A1* 9/2009 Morris Bamberg ..... A43B 3/34 702/141
2012/0253234 A1* 10/2012 Yang ..... A61B 5/1038 600/595
2021/0161429 A1* 6/2021 Chiu ..... A61B 5/6807

FOREIGN PATENT DOCUMENTS

CN 104427900 A * 3/2015 ..... A43B 3/44

* cited by examiner

*Primary Examiner* — John E Breene
*Assistant Examiner* — Alex T Devito
(74) *Attorney, Agent, or Firm* — Birch, Stewart, Kolasch & Birch, LLP

(57) ABSTRACT

A shoe includes a shoe body, a power supply unit, a sensing unit and a control unit. The power supply unit is disposed in the shoe body and is configured to provide electric power. The sensing unit and the control unit are electrically connected to the power supply unit for receiving the electric power therefrom. The sensing unit is disposed in the shoe body and is configured to continuously measure a distance to a ground. The control unit is configured to communicate with the sensing unit, to calculate a statistical value of a plurality of measured distances that are measured by the sensing unit within a predetermined period, to obtain a comparison result by comparing the statistical value with a predetermined standard, and to determine that the ground is uneven in response to determining that the comparison result is greater than a predetermined value.

16 Claims, 5 Drawing Sheets

SHOE AND METHOD FOR DETERMINING FLATNESS OF GROUND

CROSS-REFERENCE TO RELATED APPLICATION

This application claims priority to Taiwanese Invention patent application No. 112125700, filed on Jul. 10, 2023, the entire disclosure of which is incorporated by reference herein.

FIELD

The disclosure relates to a shoe and a determination method implemented by the same, and more particularly to a shoe and a method for determining flatness of a ground implemented by the same.

BACKGROUND

When people are engaged in outdoor activities (e.g., exercising or walking), they may fall or have a sprained ankle due to uneven ground conditions such as bumps, holes, or obstacles (e.g., rocks), which would stop them from continuing with the outdoor activities.

SUMMARY

Therefore, an object of the disclosure is to provide a shoe and a method for determining flatness of a ground that can alleviate at least one of the drawbacks of the prior art.

According to the disclosure, a shoe includes a shoe body, a power supply unit, a sensing unit and a control unit. The shoe body includes a sole. The power supply unit is disposed in the shoe body and is configured to provide electric power. The sensing unit is electrically connected to the power supply unit for receiving the electric power therefrom, is disposed in the sole of the shoe body, and is configured to continuously measure a distance to a ground. The control unit is electrically connected to the power supply unit for receiving the electric power therefrom, and is configured to communicate with the sensing unit, to calculate a statistical value of a plurality of measured distances that are measured by the sensing unit within a predetermined period, to obtain a comparison result by comparing the statistical value with a predetermined standard, and to determine that the ground is uneven in response to determining that the comparison result is greater than a predetermined value.

According to the disclosure, a method for determining flatness of a ground is adapted for a shoe. The shoe includes a sole, a sensing unit and a control unit. The method includes: the sensing unit continuously measuring a distance to the ground; the control unit calculating a statistical value of a plurality of measured distances that are measured by the sensing unit within a predetermined period; the control unit obtaining a comparison result by comparing the statistical value with a predetermined standard; and the control unit determining that the ground is uneven in response to determining that the comparison result is greater than a predetermined value.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
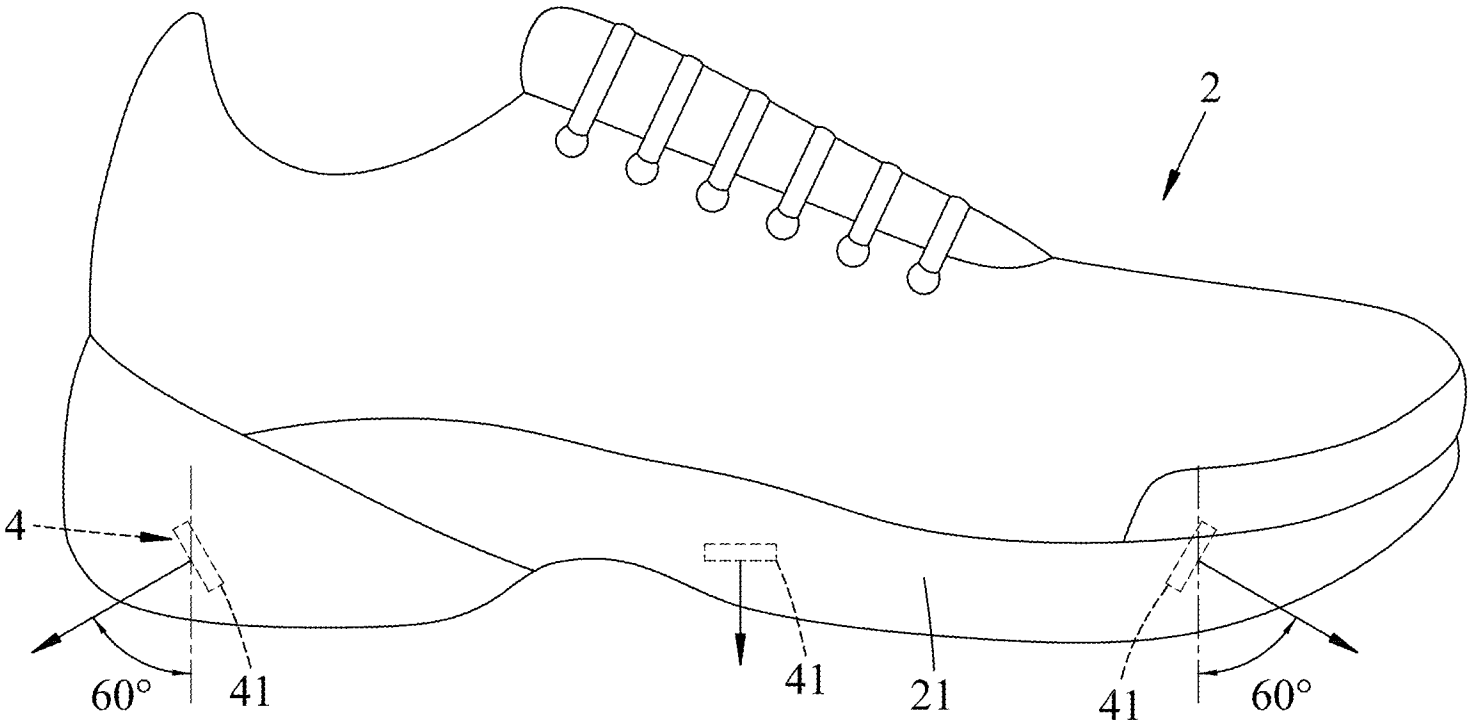
FIG. 1 is a schematic view illustrating a shoe according to an embodiment of the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
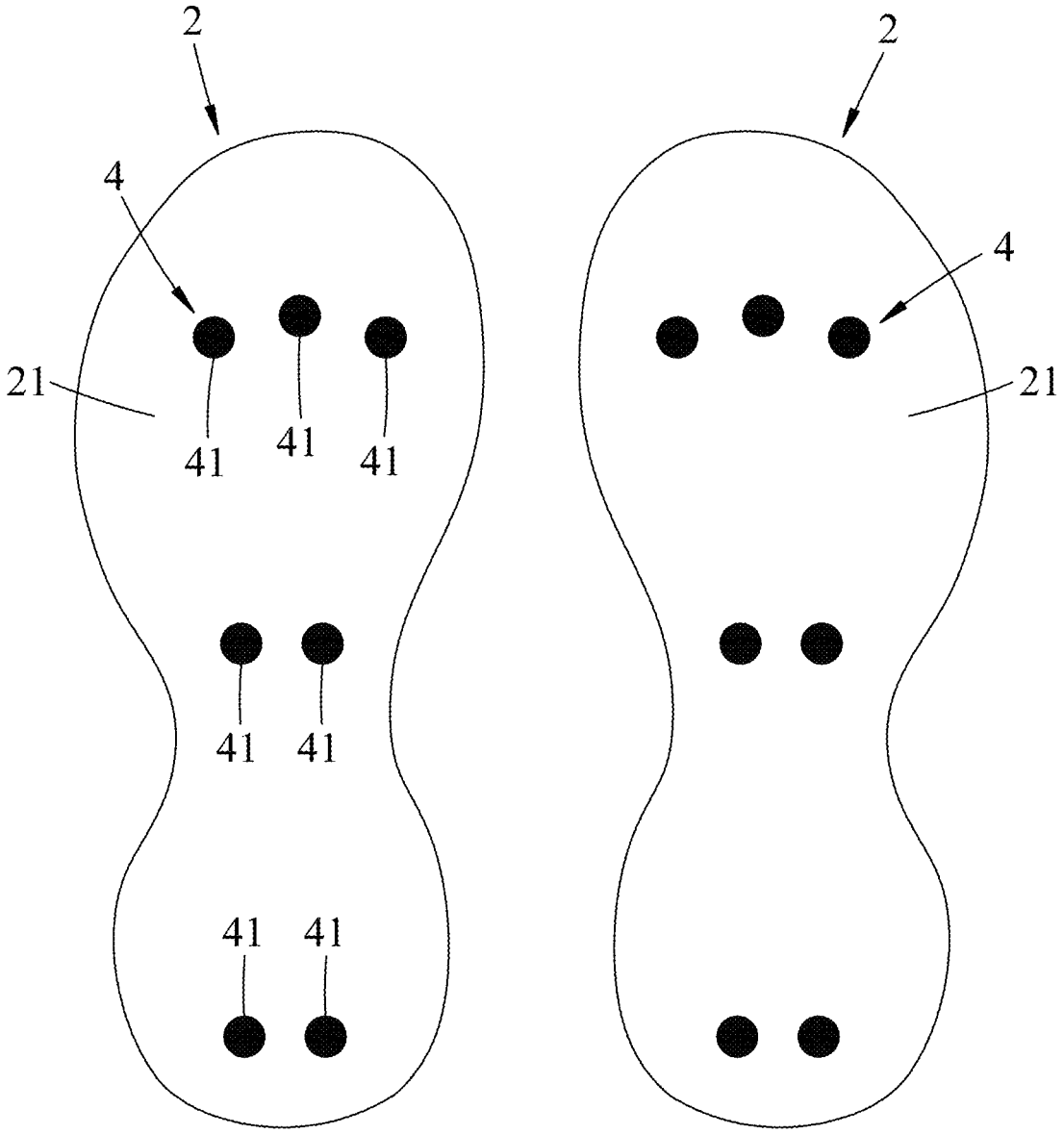
FIG. 2 is a schematic bottom view illustrating arrangement of sensors on a sole of the shoe according to the embodiment.
Figure 3:
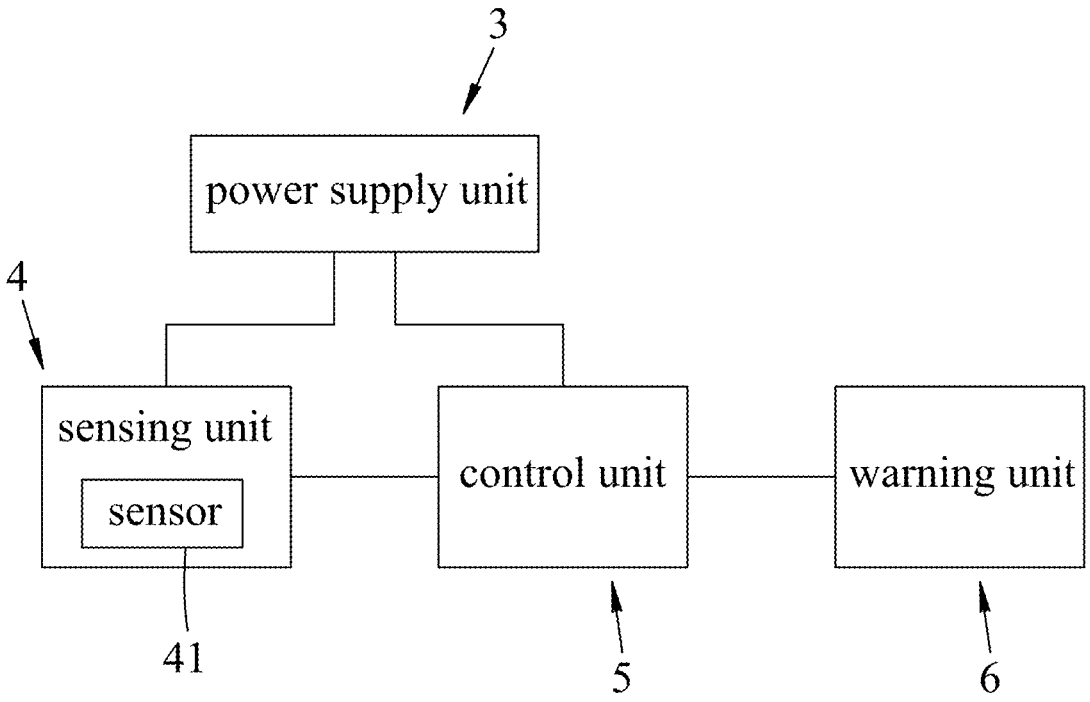
FIG. 3 is a block diagram of the embodiment.

Referring to FIGS. 1 to 3, a pair of shoes according to an embodiment of the disclosure is provided (only one is shown in FIG. 1). Each of the shoes includes a shoe body 2, a power supply unit 3, a sensing unit 4, and a control unit 5. One of the shoes, or each of the shoes may optionally further include a warning unit 6.

The shoe body 2 includes a sole 21. The power supply unit 3 is disposed in the shoe body 2 and is configured to provide electric power. In this embodiment, the power supply unit 3 is a rechargeable battery, and may be charged by a universal serial bus (USB) port or through wireless charging technology. In some embodiments, the power supply unit 3 is a disposable battery.

The sensing unit 4 is electrically connected to the power supply unit 3 for receiving the electric power therefrom, is disposed in the sole 21 of the shoe body 2 (e.g., being embedded in a midsole of the shoe, where a thickness of the midsole is greater than 12 mm), and is configured to continuously measure a distance to a ground (i.e., the distance that is measured is from the sensing unit 4 to the ground) by emitting detection waves. The sensing unit 4 includes a plurality of sensors 41 that are grouped into three sets of sensors 41, and the three sets of sensors 41 are disposed respectively at three positions on the sole 21 of the shoe body 2, where the three positions correspond to a forefoot, an arch and a heel, respectively.

Figure 4:
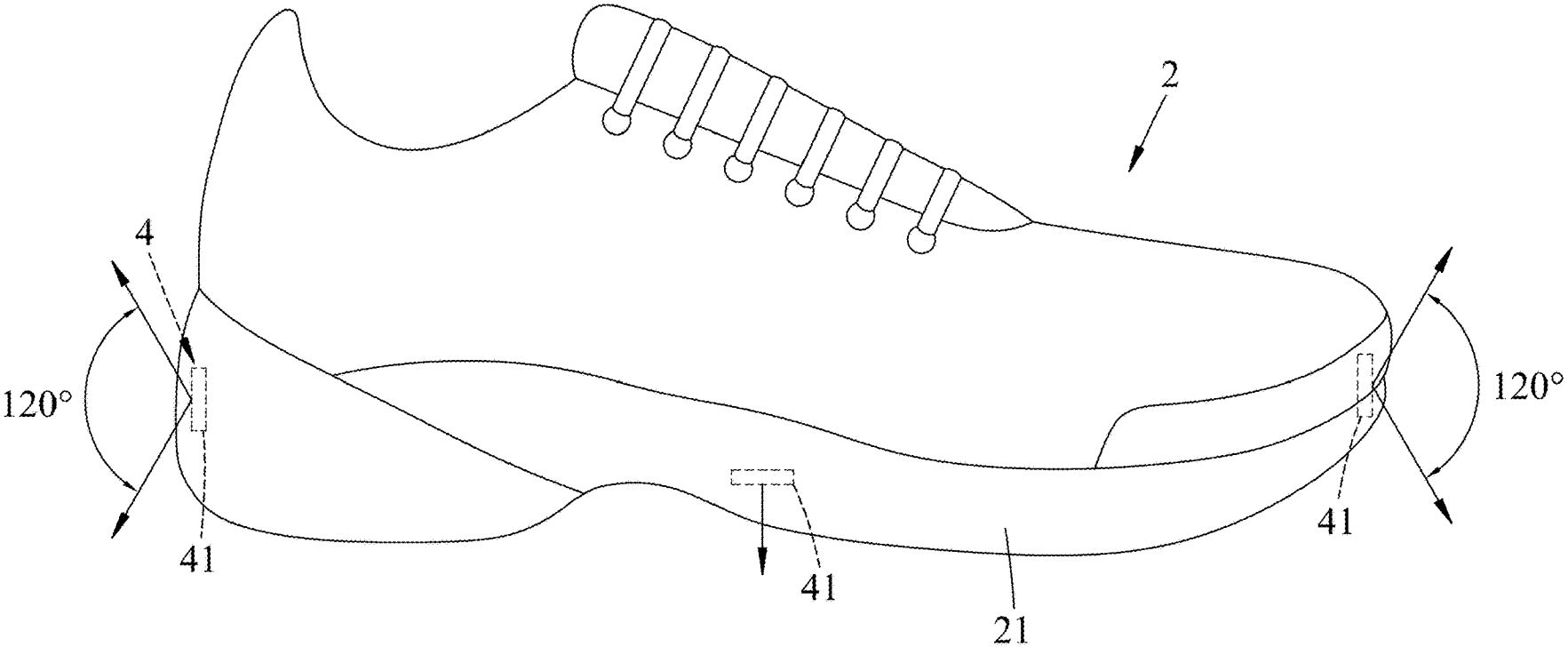
FIG. 4 is a schematic view illustrating the shoe according to another embodiment of the disclosure.

In this embodiment, as shown by the arrows in FIG. 1, the three sets of sensors 41 are disposed in a manner where one of the three sets of sensors 41 (i.e., a middle set) faces a first direction that is vertically downward (i.e., perpendicular to the ground), another one of the three sets of sensors 41 (i.e., a front set) faces a second direction that is 60 degrees forward from the first direction, and the remaining one of the three sets of sensors 41 (i.e., a rear set) faces a third direction that is 60 degrees backward from the first direction. As such, the three sets of sensors 41 may obtain ground information that includes the distances measured by the sensors 41 in the first to third directions. In some embodiments, as shown in FIG. 4, the three sets of sensors 41 are arranged to respectively face the first direction, a front of the shoe body 2, and a rear of the shoe body 2, which provides an alternative sensing configuration for measuring distances to the ground in front and at rear of the shoe body 2 in addition to measuring distances to the ground below the shoe body 2.

Referring further to FIG. 2, in this embodiment, the three sets of sensors 41 respectively include three of the sensors 41 (disposed at the position corresponding to the forefoot), two of the sensors 41 (disposed at the position corresponding to the arch), and two of the sensors 41 (disposed at the position corresponding to the heel). A quantity of the sensors 41 in this embodiment is equal to seven, but the disclosure is not limited to such. The quantity of the sensors 41 may be adjusted according to different demands (e.g., depending on a size of the shoe body 2, a cost for the sensors 41, or an accuracy requirement). In this embodiment, each of the sensors 41 is an ultrasonic sensor that is configured to emit and receive ultrasonic waves (i.e., the detection waves), and to operate in a frequency range of 23 kHz to 40 KHz.

The control unit 5 may be a logic circuit, or may be an integrated circuit or a system on a chip (SoC) that may include a microprocessor. The control unit 5 is configured to communicate with the sensing unit 4 so as to receive the distances measured by the sensing unit 4. In some embodiments, the control unit 5 may be embedded in the shoe body 2 and electrically connected to the power supply unit 3 for receiving the electric power therefrom. In some embodiments, the control unit 5 may be disposed in a wearable device (not shown, such as a smart watch) to receive electric power from the wearable device, or may be disposed in a portable electronic device (not shown, such as a smartphone) to receive electric power from the portable electronic device. The control unit 5 is configured to calculate a statistical value of a plurality of measured distances that are measured by the sensing unit 4 within a predetermined period, to obtain a comparison result by comparing the statistical value with a predetermined standard, and to determine that the ground is uneven and to output a warning signal in response to determining that the comparison result is greater than a predetermined value.

In this embodiment, there are three predetermined standards respectively corresponding to the three sets of sensors 41, and the control unit 5 is configured to obtain the comparison result for each of the three sets of sensors 41. That is to say, for each of the three sets of sensors 41, the control unit 5 calculates the statistical value based on those of the measured distances that are measured by the set of sensors 41, and compares the statistical value to one of the three predetermined standards that corresponds to the set of sensors 41, so as to determine whether the ground that is measured by the set of sensors 41 is uneven. In some embodiments, the control unit 5 obtains the comparison result for each of the sensors 41, so as to determine whether the ground measured by the sensor 41 is uneven.

It should be noted that for each of the sensors 41, in order to rule out false determination resulting from the sensor 41 receiving signals that are emitted by another one of the sensors 41, if any one of the measured distances has a large difference (e.g., a difference of 2% to 6%) in comparison to a previous one of the measured distances or to a latter one of the measured distances (or to an average value of the measured distances measured by the same set of the sensors 41), then the one of the measured distances will not be used by the control unit 5 for calculating the statistical value. Specifically, the previous one of the measured distances, the one of the measured distances, and the latter one of the measured distances are three consecutive ones of the measured distances that are measured by the same sensor 41.

To describe in further detail, the control unit 5 is configured to calculate an average value of the measured distances within the predetermined period as the statistical value, where the predetermined period may range from 1 to 3 second(s). Each of the predetermined standards may be a predetermined distance, or a predetermined range that has a maximum value and a minimum value.

When the predetermined standard is the predetermined distance, the control unit 5 calculates a difference between the statistical value and the predetermined distance as the comparison result, and determines that the ground is uneven when the difference between the statistical value and the predetermined distance is greater than the predetermined value (e.g., 3 cm to 5 cm). The predetermined standard (i.e., the predetermined distance) may be a fixed distance, or may be set to the fixed distance initially, and then be dynamically updated according to a movement of a user who is wearing the shoes. To describe in further detail, when the user is walking, if the control unit 5 determines that the difference between the statistical value and the predetermined distance is less than the predetermined value, then the control unit 5 adjusts the predetermined distance by calculating an average value of the statistical value and the predetermined distance, and sets the predetermined distance to be equal to the average value. For example, assuming that the predetermined distance is set to be 7.5 cm initially, and assuming that the statistical value is calculated to be 6.5 cm, the control unit 5 calculates the average value of 6.5 cm and 7.5 cm, which is equal to 7.0 cm, and the predetermined distance is set to be 7.0 cm instead of the initial 7.5 cm.

When the predetermined standard is the predetermined range, the control unit 5 calculates a first difference by subtracting the maximum value from the statistical value and a second difference by subtracting the statistical value from the minimum value as the comparison result, and determines that the ground is uneven when the first difference is greater than the predetermined value (when the statistical value is greater than the maximum value by more than the predetermined value, which indicates that there is a depression in the ground) or when the second difference is greater than the predetermined value (when the statistical value is less than the minimum value by more than the predetermined value, which indicates that there is a bump or an obstacle on the ground). The predetermined standard (i.e., the predetermined range) may be a fixed range, or may be set to the fixed range initially, and then be dynamically updated according to the movement of the user. To describe in further detail, when the user is walking, if the control unit 5 determines that the first difference and the second difference are both less than the predetermined value, then the control unit 5 adjusts the predetermined range by: 1) calculating a first average value of the maximum value and the minimum value; 2) calculating a second average value of the statistical value and the first average value; and 3) adjusting the predetermined range in a manner where an interval of the predetermined range that has been adjusted is unchanged and an average value of the maximum value and the minimum value of the predetermined range that has been adjusted is equal to the second average value. For example, assuming that the predetermined range is initially set to be 5-10 cm with an interval of 5 cm, and assuming that the statistical value is calculated to be 6.5 cm, the control unit 5 calculates the first average value of 5 cm and 10 cm, which is equal to 7.5 cm, and then calculates the second average value of 6.5 cm and 7.5 cm, which is equal to 7.0 cm, and the predetermined range is set to be 4.5-9.5 cm (which has an average value of 7.0 cm and the interval of the predetermined range is unchanged).

When the control unit 5 determines that the statistical value is less than a static distance for longer than a predetermined time period, it indicates that the shoe body 2 is stationary, and the control unit 5 controls the sensing unit 4 to stop measuring distances to the ground. The static distance is, for example, 0 to 3 cm, and the predetermined time period is, for example, 5 to 10 seconds. In some embodiments, when the control unit 5 determines that the shoe body 2 is stationary, the control unit 5 may control a motion detection device (not shown, such as an accelerometer or a gyroscope) that is disposed in the shoe body 2 to detect whether the shoe body 2 is in motion, and if the shoe body 2 is determined to be in motion, the motion detection device may generate and send a signal to the control unit 5, so that the control unit 5 may control the sensing unit 4 to resume measuring the distance to the ground upon receiving the signal. In some embodiments, when the control unit 5 is disposed in the wearable device or the portable electronic device, the user may send the signal to the control unit 5 through controlling the wearable device or the portable electronic device, so that the control unit 5 may control the sensing unit 4 to resume measuring the distance to the ground.

The warning unit 6 is signally connected to the control unit 5 for receiving the warning signal, and is configured to output an alert in the form of light or sound to warn the user that the ground is uneven upon receiving the warning signal. For example, the warning unit 6 may be embodied using a light-emitting diode (LED) device or a buzzer. The warning unit 6 may be disposed in the shoe body 2, or may be disposed in the wearable device or the portable electronic device. Details of implementing the warning unit 6 is well known to one having ordinary skill in the art, and will not be described in further detail for the sake of brevity.

Figure 5:
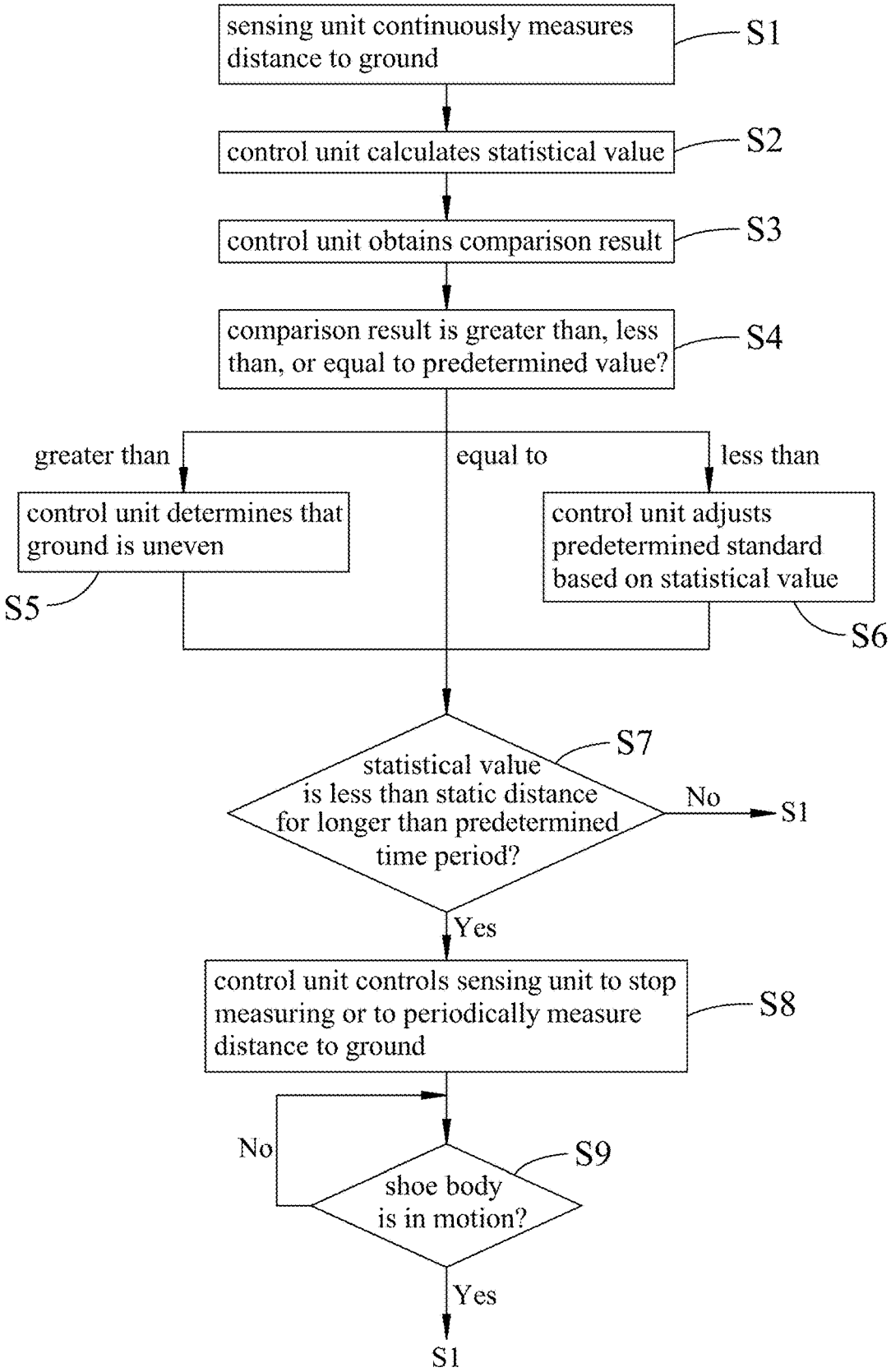
FIG. 5 is a flow chart illustrating a method for determining flatness of a ground according to an embodiment of the disclosure.

Referring to FIG. 5, a method for determining flatness of the ground is implemented by the shoe and includes steps S1 to S9.

In step S1, the sensing unit 4 continuously measures the distance to the ground by continuously emitting and receiving the detection waves.

In step S2, the control unit 5 calculates the statistical value of the measured distances that are measured by the sensing unit 4 within the predetermined period.

In step S3, the control unit 5 obtains the comparison result by comparing the statistical value with the predetermined standard, where the predetermined standard may be the predetermined distance or the predetermined range.

In step S4, the control unit 5 determines whether the comparison result is greater than, less than, or equal to the predetermined value, and if the comparison result is greater than the predetermined value, the flow proceeds to step S5; if the comparison result is less than the predetermined value, the flow proceeds to step S6; and if the comparison result is equal to the predetermined value, the flow goes to step S7.

In step S5, when the control unit 5 determines that the comparison result is greater than the predetermined value, the control unit 5 determines that the ground is uneven, and the flow proceeds to step S7. In a case where the predetermined standard is the predetermined distance, the comparison result is the difference between the statistical value and the predetermined distance. In a case where the predetermined standard is the predetermined range, the comparison result is the first difference and the second difference. In some embodiments where the shoe includes the warning unit 6, step S5 may further include the control unit 5 outputting the warning signal to the warning unit 6 so that the warning unit 6 outputs the alert.

In step S6, when the control unit 5 determines that the comparison result is less than the predetermined value, the control unit 5 adjusts the predetermined standard based on the statistical value, and the flow proceeds to step S7. In a case where the predetermined standard is the predetermined distance, the control unit 5 calculates the average value of the statistical value and the predetermined distance, and sets the predetermined distance to be equal to the average value. In a case where the predetermined standard is the predetermined range, the control unit 5 calculates the first average value of the maximum value and the minimum value, calculates the second average value of the statistical value and the first average value, and adjusts the predetermined range in a manner where the interval of the predetermined range that has been adjusted is unchanged and the average value of the maximum value and the minimum value of the predetermined range that has been adjusted is equal to the second average value.

In step S7, the control unit 5 determines whether the statistical value is less than the static distance for longer than the predetermined time period, and if affirmative, the flow proceeds to step S8; otherwise, the flow goes back to step S1.

In step S8, the control unit 5 controls the sensing unit 4 to stop measuring or to periodically measure the distance to the ground. In some embodiments, the control unit 5 controls the sensing unit 4 to stop operating, so as to stop measuring the distance to the ground. In some embodiments, the control unit 5 controls the sensors 41 to periodically emit the detection waves with a predetermined time interval (e.g., two seconds or more) instead of continuously emitting the detection waves, so as to reduce power consumption. In some embodiments where the shoe includes the motion detection device, step S8 may further proceed to step S9.

In step S9, the control unit 5 controls the motion detection device to detect whether the shoe body 2 is in motion, and if affirmative, the motion detection device generates and sends the signal to the control unit 5, so that the flow of the method goes back to step S1 (i.e., the control unit 5 controls the sensing unit 4 to resume measuring the distance to the ground upon receiving the signal); otherwise, step S9 is repeated.

In some embodiments, step S7 may be performed independently from step S4, as long as step S7 is performed after step S2. It should be noted that the orders of the steps of the method may be arranged differently from the abovementioned example as long as necessary information is obtained before each of the steps is performed.

In summary, according to the disclosure, the sensing unit 4 is configured to continuously measure the distance to the ground, and the control unit 5 is capable of calculating and analyzing information related to the ground based on a large amount of data (i.e., the measured distances) that is collected when the user is walking, so as to determine whether the ground is uneven based on the comparison result and the predetermined value. The control unit 5 may further cooperate with the warning unit 6 to warn the user that the ground is uneven so as to reduce a risk of the user falling. Moreover, the control unit 5 is configured to dynamically adjust the predetermined standard based on the statistical value, so that the predetermined standard may better fit a waking habit of the user, thereby increasing an accuracy for determining whether the ground is uneven. Furthermore, when determining that the statistical value is less than the static distance for longer than the predetermined time period, the control unit 5 controls the sensing unit 4 to stop measuring the distance to the ground, or to periodically emit the detection waves with the predetermined time interval, so as to reduce unnecessary power consumption.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A shoe comprising:

a shoe body including a sole;

a power supply unit disposed in said shoe body and configured to provide electric power;

a sensing unit electrically connected to said power supply unit for receiving the electric power therefrom, said sensing unit being disposed in said sole of said shoe body and configured to continuously measure a distance to a ground; and a control unit electrically connected to said power supply unit for receiving the electric power therefrom, said control unit being configured to communicate with said sensing unit, to calculate a statistical value of a plurality of measured distances that are measured by said sensing unit within a predetermined period, to obtain a comparison result by comparing the statistical value with a predetermined standard, and to determine that the ground is uneven in response to determining that the comparison result is greater than a predetermined value.

2. The shoe as claimed in claim 1, wherein the predetermined standard is a predetermined distance, and said control unit is configured to calculate a difference between the statistical value and the predetermined distance as the comparison result.

3. The shoe as claimed in claim 2, wherein said control unit is further configured, in response to determining that the difference between the statistical value and the predetermined distance is less than the predetermined value, to adjust the predetermined distance by calculating an average value of the statistical value and the predetermined distance, and setting the predetermined distance to be equal to the average value.

4. The shoe as claimed in claim 1, wherein the predetermined standard is a predetermined range that has a maximum value and a minimum value, and wherein said control unit is configured to calculate a first difference by subtracting the maximum value from the statistical value and a second difference by subtracting the statistical value from the minimum value as the comparison result, and to determine that the ground is uneven in response to determining that one of the first difference and the second difference is greater than the predetermined value.

5. The shoe as claimed in claim 4, wherein said control unit is further configured, in response to determining that the first difference and the second difference are both less than the predetermined value, to adjust the predetermined range by:

calculating a first average value of the maximum value and the minimum value;

calculating a second average value of the statistical value and the first average value; and adjusting the predetermined range in a manner where an interval of the predetermined range that has been adjusted is unchanged and an average value of the maximum value and the minimum value of the predetermined range that has been adjusted is equal to the second average value.

6. The shoe as claimed in claim 1, wherein said control unit is configured to calculate an average value of the measured distances within the predetermined period as the statistical value.

7. The shoe as claimed in claim 1, wherein said control unit is further configured to control said sensing unit to stop measuring the distance to the ground in response to determining that the statistical value is less than a static distance for longer than a predetermined time period.

8. The shoe as claimed in claim 1, wherein said sensing unit is configured to continuously measure the distance to the ground by emitting detection waves, wherein said control unit is further configured to, in response to determining that the statistical value is less than a static distance for longer than a predetermined time period, control said sensing unit to periodically emit the detection waves with a predetermined time interval.

9. The shoe as claimed in claim 1, wherein said sensing unit includes three sensors that are disposed at three positions on said sole of said shoe body respectively, and wherein the three positions correspond to a forefoot, an arch and a heel, respectively.

10. A method for determining flatness of a ground adapted for a shoe, the shoe including a sole, a sensing unit and a control unit, the method comprising:

the sensing unit continuously measuring a distance to the ground;

the control unit calculating a statistical value of a plurality of measured distances that are measured by the sensing unit within a predetermined period;

the control unit obtaining a comparison result by comparing the statistical value with a predetermined standard; and the control unit determining that the ground is uneven in response to determining that the comparison result is greater than a predetermined value.

11. The method as claimed in claim 10, wherein the predetermined standard is a predetermined distance, and obtaining the comparison result is to calculate a difference between the statistical value and the predetermined distance.

12. The method as claimed in claim 11, further comprising, in response to determining that the difference between the statistical value and the predetermined distance is less than the predetermined value, the control unit adjusting the predetermined distance by calculating an average value of the statistical value and the predetermined distance, and setting the predetermined distance to be equal to the average value.

13. The method as claimed in claim 10, wherein the predetermined standard is a predetermined range that has a maximum value and a minimum value, obtaining the comparison result is to calculate a first difference by subtracting the maximum value from the statistical value and a second difference by subtracting the statistical value from the minimum value, and the control unit determines that the ground is uneven in response to determining that one of the first difference and the second difference is greater than the predetermined value.

14. The method as claimed in claim 13, further comprising, in response to determining that the first difference and the second difference are both less than the predetermined value, the control unit adjusting the predetermined range by:

calculating a first average value of the maximum value and the minimum value;

calculating a second average value of the statistical value and the first average value; and adjusting the predetermined range in a manner where an interval of the predetermined range that has been adjusted is unchanged and an average value of the maximum value and the minimum value of the predetermined range that has been adjusted is equal to the second average value.

15. The method as claimed in claim 10, further comprising the control unit controlling the sensing unit to stop detecting in response to determining that the statistical value is less than a static distance for longer than a predetermined time period.

16. The method as claimed in claim 10, wherein continuously measuring the distance to the ground is to continuously emit and receive detection waves, the method further comprising, in response to determining that the statistical value is less than a static distance for longer than a predetermined time period, the control unit controlling the sensing unit to periodically emit the detection waves with a predetermined time interval.

* * * * *